US008251718B2

(12) United States Patent
Chen et al.

(10) Patent No.: US 8,251,718 B2
(45) Date of Patent: Aug. 28, 2012

(54) POWER DEVICE WITH A MOVABLE CONNECTOR PLUG

(75) Inventors: Shang-Ting Chen, Jhongli (TW); Chih-Chan Ger, Jhongli (TW); Ko-Wen Wang, Jhongli (TW); Yu-Hsiang Liao, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 0 days.

(21) Appl. No.: 12/978,425

(22) Filed: Dec. 24, 2010

(65) Prior Publication Data

US 2011/0223787 A1 Sep. 15, 2011

(30) Foreign Application Priority Data

Mar. 12, 2010 (CN) ..... 2010 2 0129685 U

(51) Int. Cl.
*H01R 13/44* (2006.01)

(52) U.S. Cl. ..... 439/131

(58) Field of Classification Search ..... 439/131, 439/172, 173, 518, 521; 320/114
See application file for complete search history.

(56) References Cited

U.S. PATENT DOCUMENTS 4,622,507 A * 11/1986 Persen ..... 320/111
4,973,827 A * 11/1990 Nozaki ..... 219/521
5,449,567 A * 9/1995 Yeh ..... 429/7
6,638,113 B2 * 10/2003 Kajiwara et al. ..... 439/651
6,780,033 B2 * 8/2004 Liu ..... 439/172
7,265,517 B2 * 9/2007 Bumiller ..... 320/114
7,439,709 B2 * 10/2008 Bumiller ..... 320/114
7,618,292 B1 * 11/2009 Lin et al. ..... 439/640
7,688,030 B2 * 3/2010 Bumiller ..... 320/114
7,794,251 B2 * 9/2010 Wen et al. ..... 439/173
7,946,884 B2 * 5/2011 Chiang et al. ..... 439/518
8,052,441 B2 * 11/2011 Senatori et al. ..... 439/171
8,182,274 B1 * 5/2012 Cheng et al. ..... 439/131
2002/0127898 A1 * 9/2002 Liu ..... 439/131
2010/0173514 A1 * 7/2010 Chiang et al. ..... 439/357
2010/0190364 A1 * 7/2010 Niidome et al. ..... 439/131

* cited by examiner

*Primary Examiner* — Alexander Gilman

(74) *Attorney, Agent, or Firm* — Altis Law Group, Inc.

(57) ABSTRACT

A power device includes a substrate portion and a connector plug. The substrate portion defines a recess portion and a pair of receiving grooves, and includes at least one contact terminal. The connector plug includes a main body and a pair of conducting strips protruding outwardly from the main body. The main body defines at least one receiving slot. The pair of conducting strips are received in the receiving grooves correspondingly and the contact terminals slide into the corresponding receiving slots to accommodate the connector plug in the substrate portion. The main body and the recess portion are in a square shape respectively, so that the connector plug is capable of turning for 90 degrees relative to the substrate portion to be mounted on the substrate portion.

20 Claims, 10 Drawing Sheets

POWER DEVICE WITH A MOVABLE CONNECTOR PLUG

BACKGROUND

1. Technical Field

The present disclosure relates to a power device with a movable connector plug.

2. Description of Related Art

Electronic products need power devices to supply power. These power devices have similar circuits which comprise converting circuits for converting alternating current into direct current. Connector plugs are necessary elements of these power devices for the power devices to receive power from a power source.

With reference to FIG. 10, a typical power device 50 comprises a main body 52 and a connector plug 54 mounted on the main body 52. The connector plug 54 comprises a pair of male contacts 540 mating with a pair of jacks of a connector socket (not shown). The connector plug 54 further comprises a pair of contact terminals 544 opposite to the pair of male contacts 540 and a pair of protruding shafts 542 perpendicularly intersected with the pair of contact terminals 544. The pair of protruding shafts 542 can be mounted onto the main body 52 to mount the connector plug 54 on the main body 52. The main body 52 comprises a pair of conducting strips 520 contacting with the pair of contact terminals 544 in use. When the power device 50 is not in use, such as being packaged or portable, the connector plug 54 is received in the main body 54 by rotating the connector plug 54 around the pair of protruding shafts 542 anti-clockwise.

Although it is convenient for package, it is easy to disengage the connector plug 54 from the main body 52, and the connector plug 54 is still inserted in the connector socket which may cause danger while the pair of contact terminals 544 is not shielded by the a pair of conducting strips 520. Therefore, it is easy to get an electric shock when pulling out the power device 50. Otherwise, the power device 50 cannot be changed to different using directions. For example, when the power device 50 is inserted into one connector socket, the other connector socket shielded by the power device 50 cannot be used at the same time.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
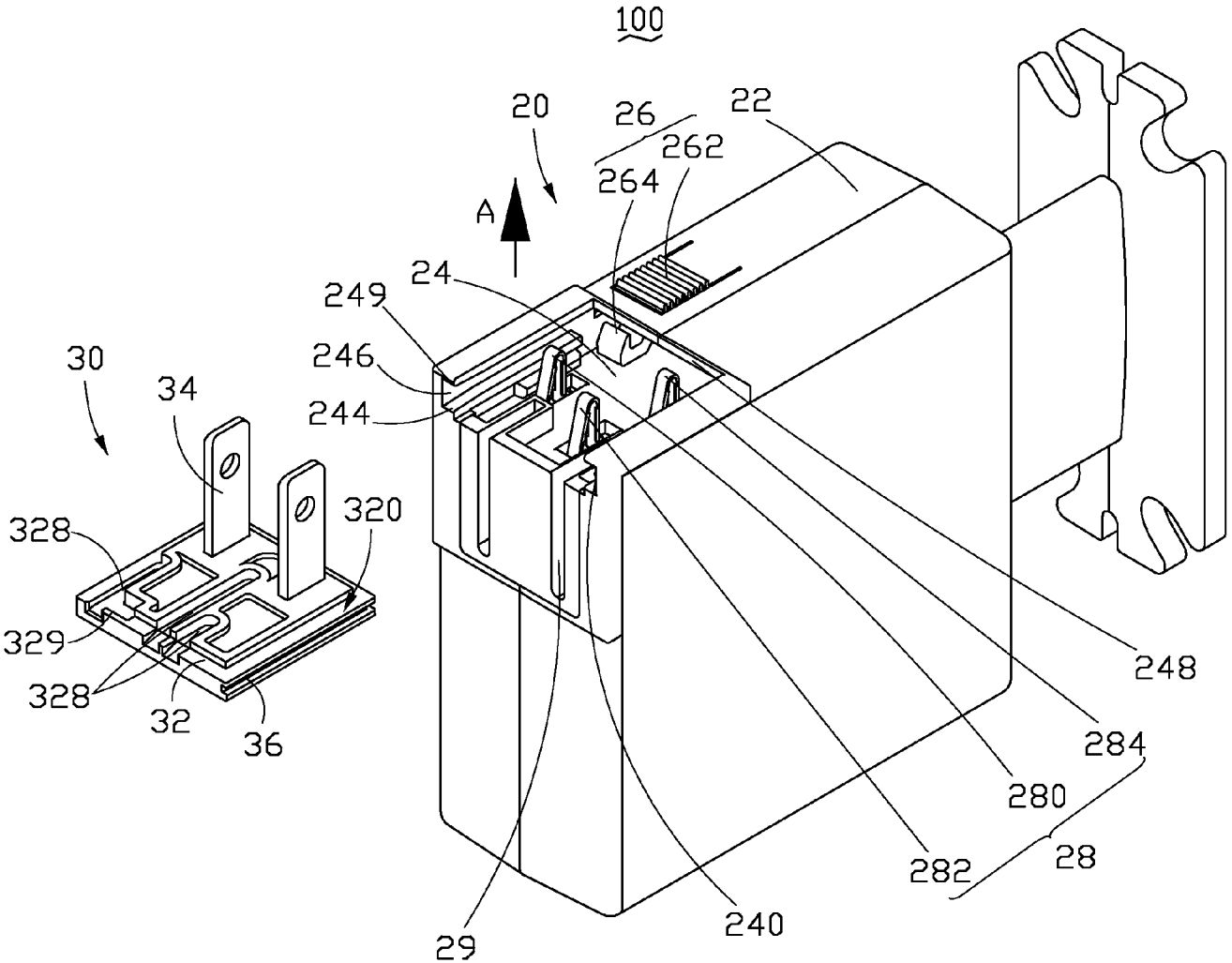
FIG. 1 is a disassembled perspective view of a first preferred embodiment of a power device in accordance with the present disclosure, showing the power device in a first position.

FIG. 1 is a first preferred embodiment of a power device 100 in accordance with the present disclosure. The power device 100 comprises a substrate portion 20 and a connector plug 30.

Figure 2:
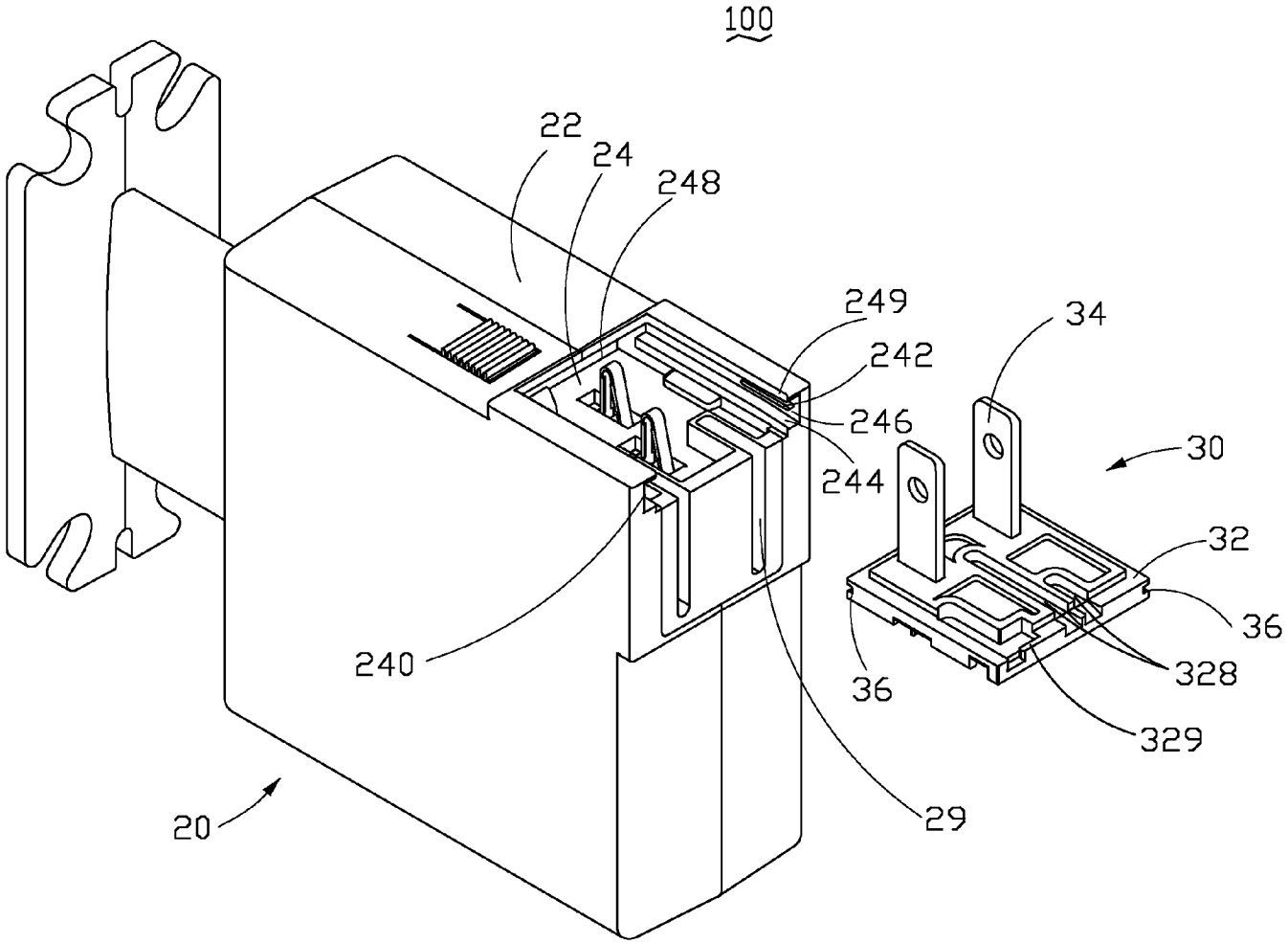
FIG. 2 is a disassembled perspective view of FIG. 1, showing the power device in a second position.

Referring to FIG.1 and FIG. 2, the substrate portion 20 is shell-type structure and comprises a top wall 22. On one portion of the top wall 22, the substrate portion 20 further comprises a pair of first inside walls 246, a pair of stopper portions 249, a pair of step portions 244 and a second inside wall 248. The pair of first inside walls 246 and the second inside wall 248 collectively define a recess portion 24 to receive the connector plug 30. The pair of first inside walls 246 are opposite to each other and perpendicular to the second inside wall 248 respectively. Each of the pair of stopper portions 249 protrudes from a top portion of the corresponding first inside wall 246 towards the recess portion 24. Each of the pair of step portions 244 is opposite to the corresponding stopper portion 249 and protrudes from a bottom portion of the corresponding first inside wall 246 towards the recess portion 24.

In the illustrated embodiment, the pair of stopper portions 249, the pair of first inside walls 246 and the pair of step portions 244 collectively form a pair of first sliding grooves 240 configured in a "U" shape. The pair of U-shaped first sliding grooves 240 face each other. The connector plug 30 can move along the pair of U-shaped first sliding grooves 240. One of the pair of the first inside walls 246 comprises a position portion 242 disposed between the corresponding stopper portion 249 and the corresponding step portion 244 to position the connector plug 30 relatively to the recess portion 24. The position portion 242 protrudes from the middle of the first inside wall 246 towards the recess portion 24.

The substrate portion 20 comprises at least one contact terminal 28 passing through a bottom of the recess portion 24 and extending towards the recess portion 24. The at least one contact terminal 28 comprises a first contact terminal 280, a second contact terminal 282 and a third contact terminal 284. The first contact terminal 280 connects with the second contact terminal 282 in a short circuit manner The substrate portion 20 further comprises a securing portion 26 disposed on the top wall 22. The securing portion 26 comprises an operating portion 262 and a latch hook 264 protruding downwardly from the operating portion 262 into the recess portion 24. In the illustrated embodiment, the operating portion 262 is integrally formed with the top wall 22 with elasticity operable to be pressed up and down and the latch hook 264 is integrally formed with the operating portion 262. In the embodiment, the operating portion 262 comprises a plurality of ribs in parallel with each other thereon convenient for user's operation.

Figure 3:
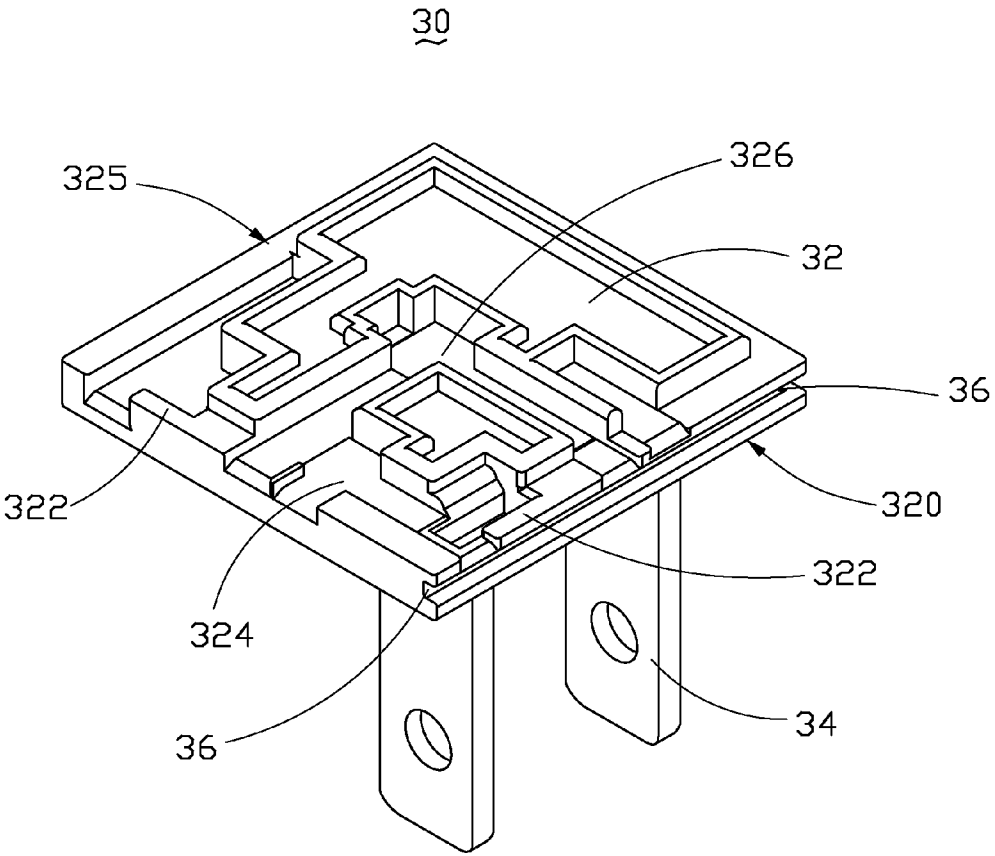
FIG. 3 is a perspective view of the first preferred embodiment of a connector plug of the power device of FIG. 1.

Referring to FIG. 3, the connector plug 30 comprises a main body 32 and a pair of conducting strips 34 protruding outwardly from a first side surface 320 of the main body 32. In the illustrated embodiment, the pair of conducting strips 34 are structured, but not limited, in a tabular shape. The main body 32 is substantially in a rectangular shape and defines two successive second sliding grooves 36 on two adjacent sides of the main body 32. In the illustrated embodiment, a cross section of the second sliding groove 36 is substantially in a "U" shape. When the connector plug 30 slides along the first sliding groove 240, the position portion 242 is received in the second sliding groove 36 to guide the second sliding groove 36 moving in the first sliding groove 240 and the pair of stopper portions 249 limit the connector plug 30 moving on the perpendicular direction A relative to the substrate portion 20. Therefore, the connector plug 30 is mounted on the substrate portion 20.

In the illustrated embodiment, the main body 32 and the recess portion 24 both are in symmetrically shaped, such as square.

The main body 32 comprises a second side surface 325 and a plurality of second blocking walls 322 protruding outwardly from the second side surface 325. In assembly, the latch hook 264 of the substrate portion 20 engages with one of the plurality of second blocking walls 322 by controlling the operating portion 262 to securely latch the connector plug 30 with the substrate portion 20. The second side surface 325 comprises a first sheet metal 324 and a second sheet metal 326 both contacting with the contact terminals 28 to electrically connect the connector plug 30 with the substrate portion 20. The second sheet metal 326 substantially locates at the middle of the main body 32. The first sheet metal 324 insulates from the second sheet metal 326 by the plurality of second blocking walls 322.

Figure 4:
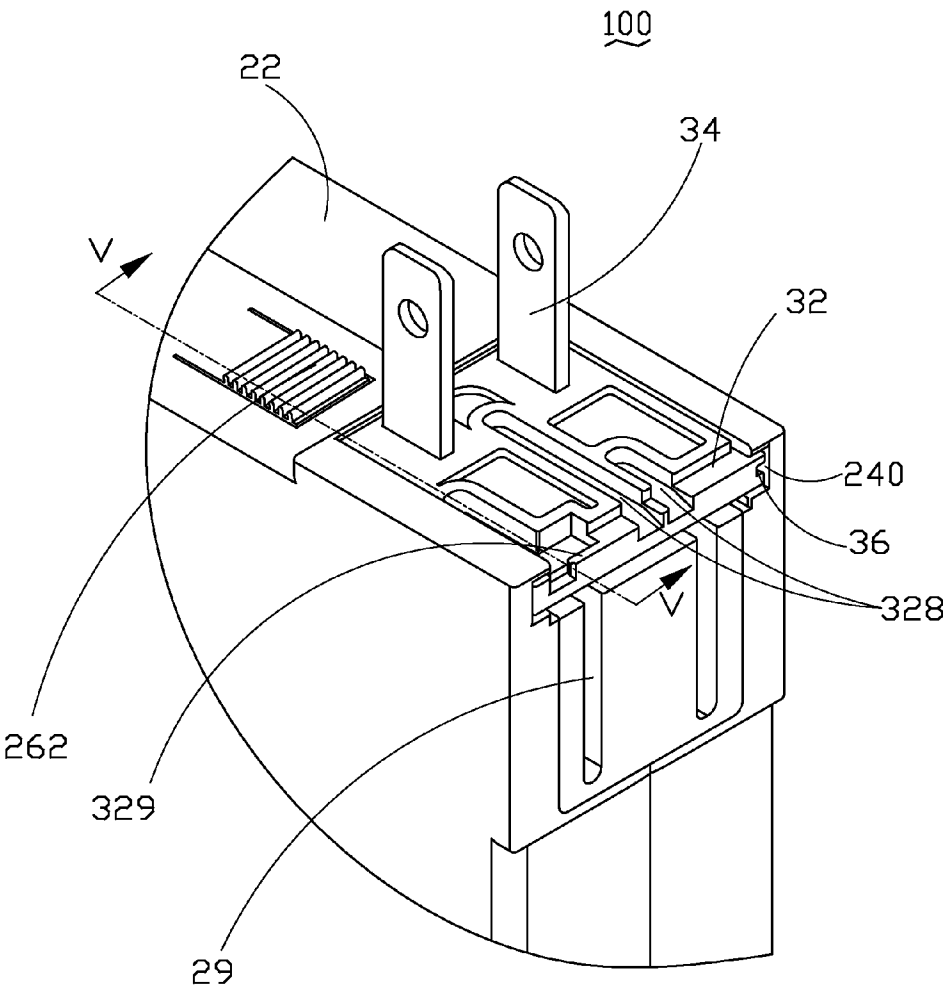
FIG. 4 is a partially assembled view of the first preferred embodiment of the power device in a first state.
Figure 5:
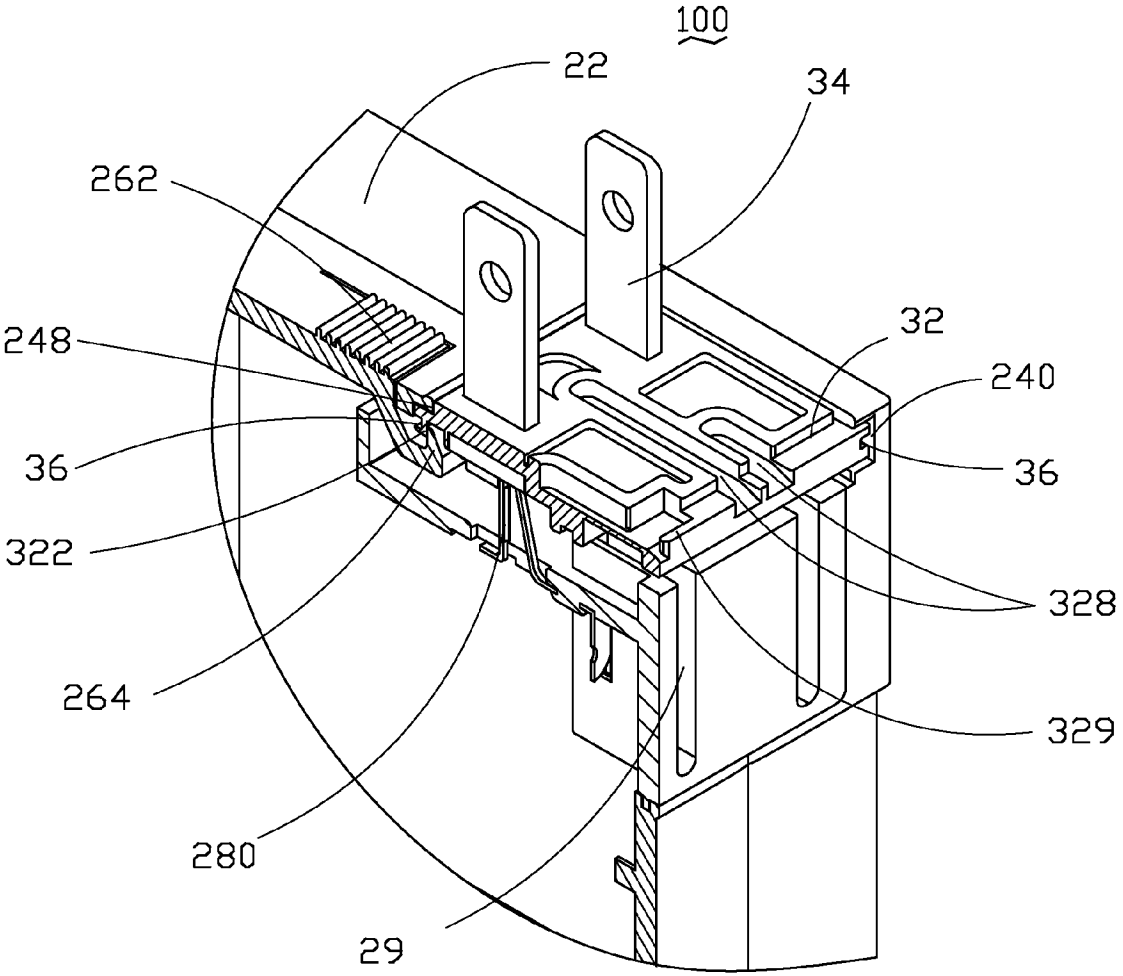
FIG. 5 is a cross-sectional view taken along line V-V of FIG. 4.

Referring to FIG. 4 and FIG. 5, when the connector plug 30 is fixed on the substrate portion 20, the second sliding groove 36 slides into the first sliding groove 240 along the position portion 242, the main body 32 is received in the recess portion 24 with the first side surface 320 upwardly, and the latch hook 264 engages with one of the plurality of second blocking walls 322 by pressing the operating portion 262. Simultaneously, the first contact terminal 280 conductively contacts with the first sheet metal 324 and the third contact terminal 284 conductively contacts with the second sheet metal 326, and this state is defined as a first state for the power device 100. However, when the operating portion 262 is pressed down and the latch hook 264 disengages from the corresponding second blocking wall 322, the main body 32 is prone to be disengaged from the recess portion 24 to disassemble the connector plug 30 from the substrate portion 20.

Figure 6:
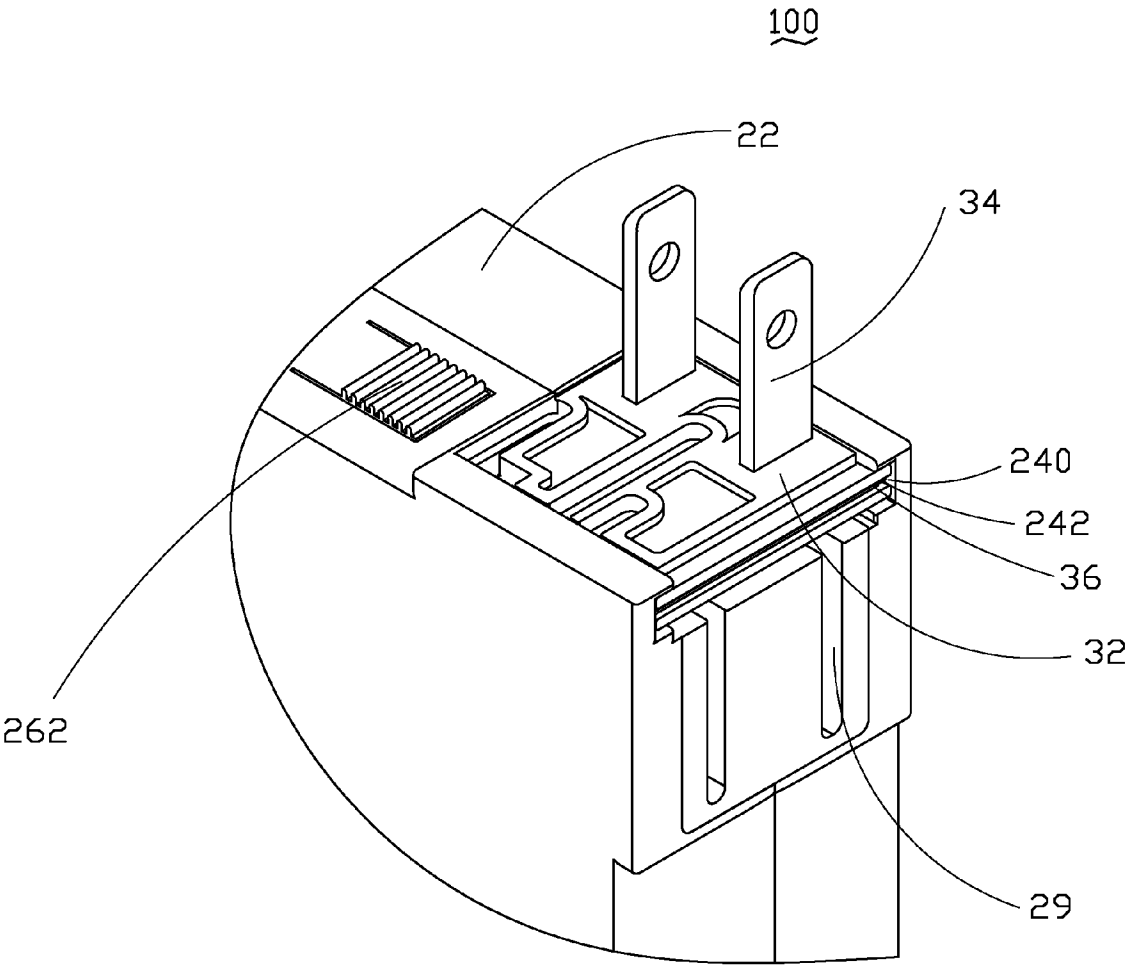
FIG. 6 is a partially assembled view of the first preferred embodiment of the power device in a second state.

In another use state, the connector plug 30 can be taken out from the substrate portion 20 and turns for 90 degrees relative to the substrate portion 20 to mount the connector plug 30 on the substrate portion 20. Therefore, the blocked connector socket can be used by the other power device. Referring to FIG. 6, the connector plug 30 is turned 90 degrees and mounted on the substrate portion 20 in another use state. Thereby, the first sheet metal 324 conductively contacts with the second contact terminal 282 and the second sheet metal 326 conductively contacts with the third contact terminal 284, and this state is defined as a second state for the power device 100.

The main body 32 and the recess portion 24 are in a square shape respectively, so that the connector plug 30 can be positioned in different positions relative to the substrate portion 20. Due to the mechanism, the power device 100 can adapt to different power sockets.

Because the operating portion 262 disposes on the top wall 22 of the substrate portion 20 and controls the latching hook 264 to engage with the corresponding second blocking wall 322, the connector plug 30 cannot be easily disengaged from the substrate portion 20 by pulling out the power device 100 from the connector socket.

The substrate portion 20 defines a pair of receiving grooves 29 extending from a bottom of the recess portion 24 into the substrate portion 20. The pair of receiving grooves 29 are used to receive the pair of conducting strips 34. The first side surface 320 of the main body 32 defines three receiving slots 328 and comprises a first blocking wall 329. The three receiving slots 328 have an open side respectively, so that the first contact terminal 280, the second contact terminal 282 and the third contact terminal 284 can slide from the corresponding open sides into the corresponding receiving slots 328. The first blocking wall 329 is configured on the side of the main body 320 far away from the conducting strips 34 and is parallel to the line of the pair of conducting strips 34. The first blocking wall 329 engages with the latching hook 364 to accommodate the connector plug 30 into the substrate portion 20.

Figure 7:
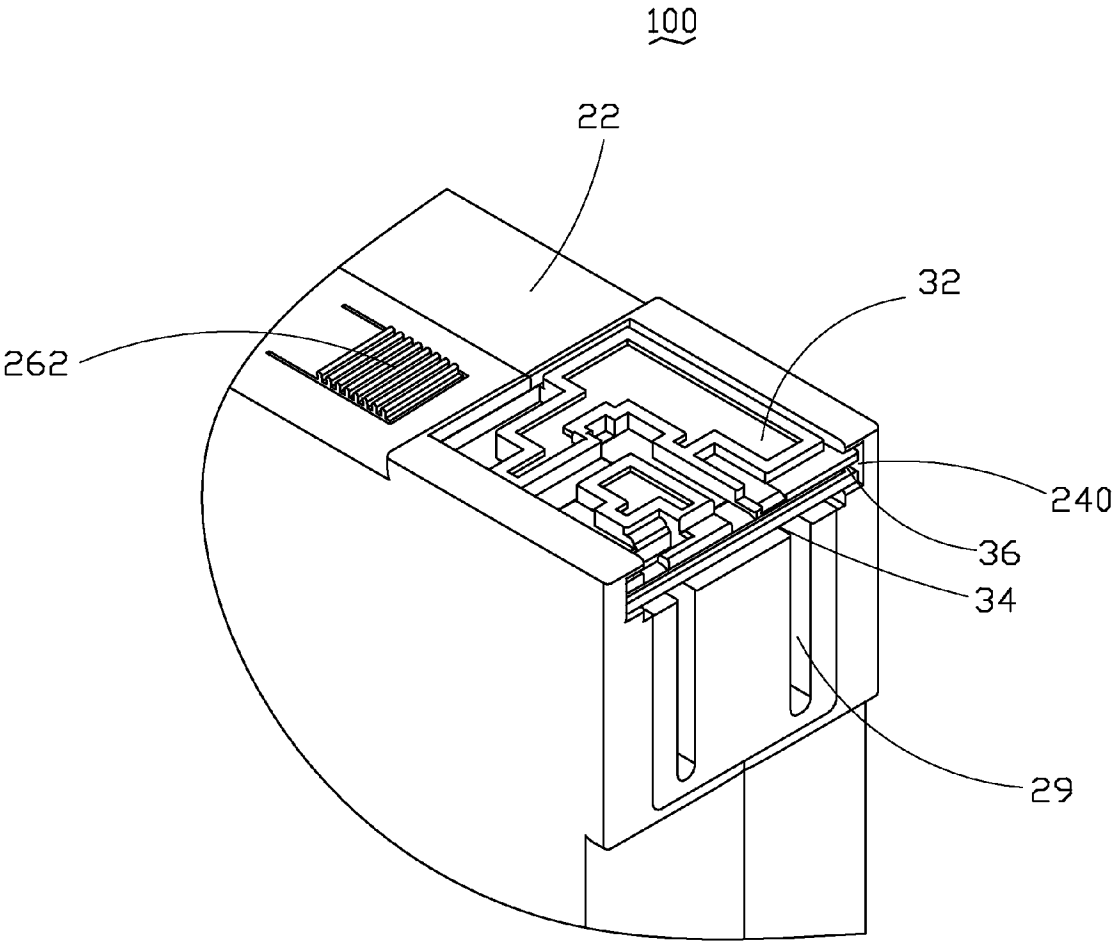
FIG. 7 is a partially assembled view of the first preferred embodiment of the power device in accordance with the present disclosure, showing the connector plug received in a substrate portion.

Referring to FIG. 7, the first side surface 320 faces to the recess portion 24, and the first contact terminal 280, the second contact terminal 282 and the third contact terminal 284 slide into the corresponding receiving slots 328 along the open sides. The first blocking wall 329 latches on the latching hook 264 by pressing down the operating portion 262 and the pair of conducting strips 34 are completely received in the receiving grooves 29 correspondingly. Therefore, the connector plug 30 is received and positioned in the substrate portion 20 to take up a small space when packaged.

Figure 8:
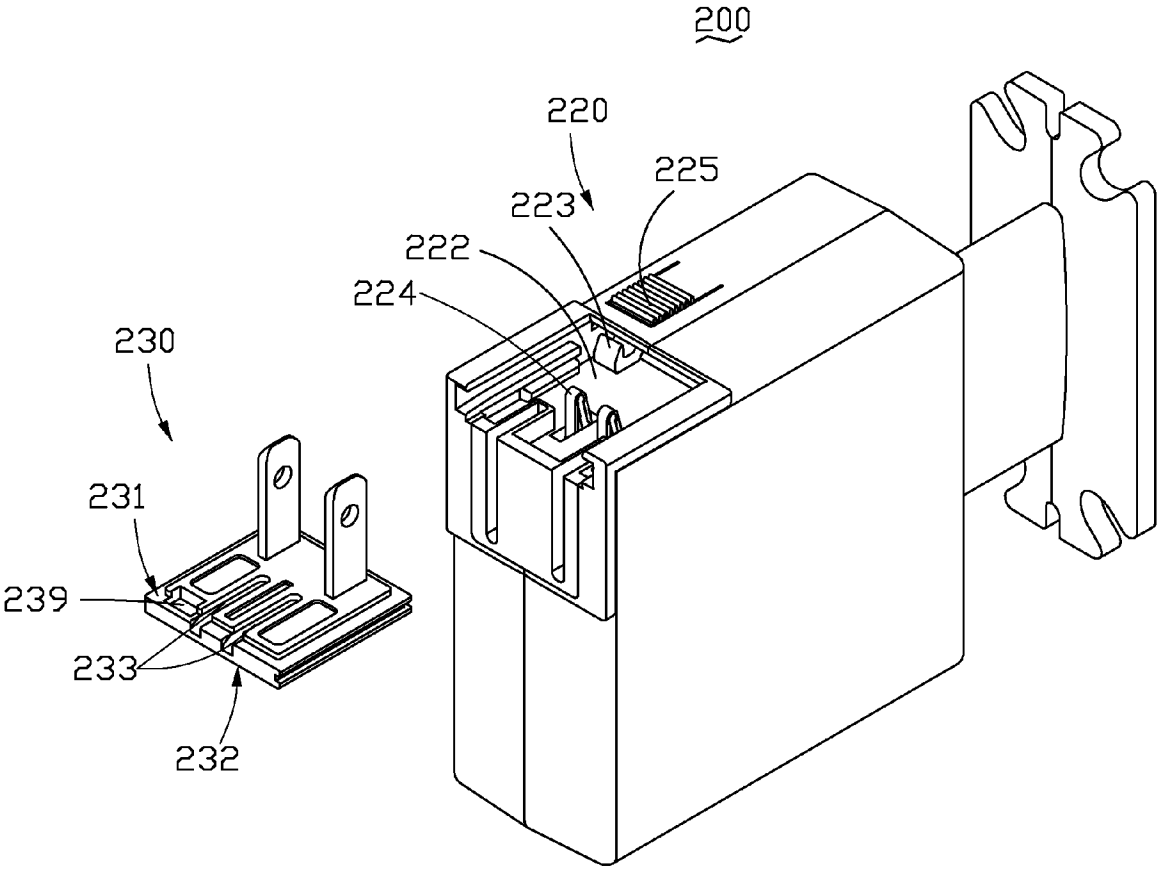
FIG. 8 is a disassembled perspective view of a second preferred embodiment of the power device in accordance with the present disclosure.
Figure 9:
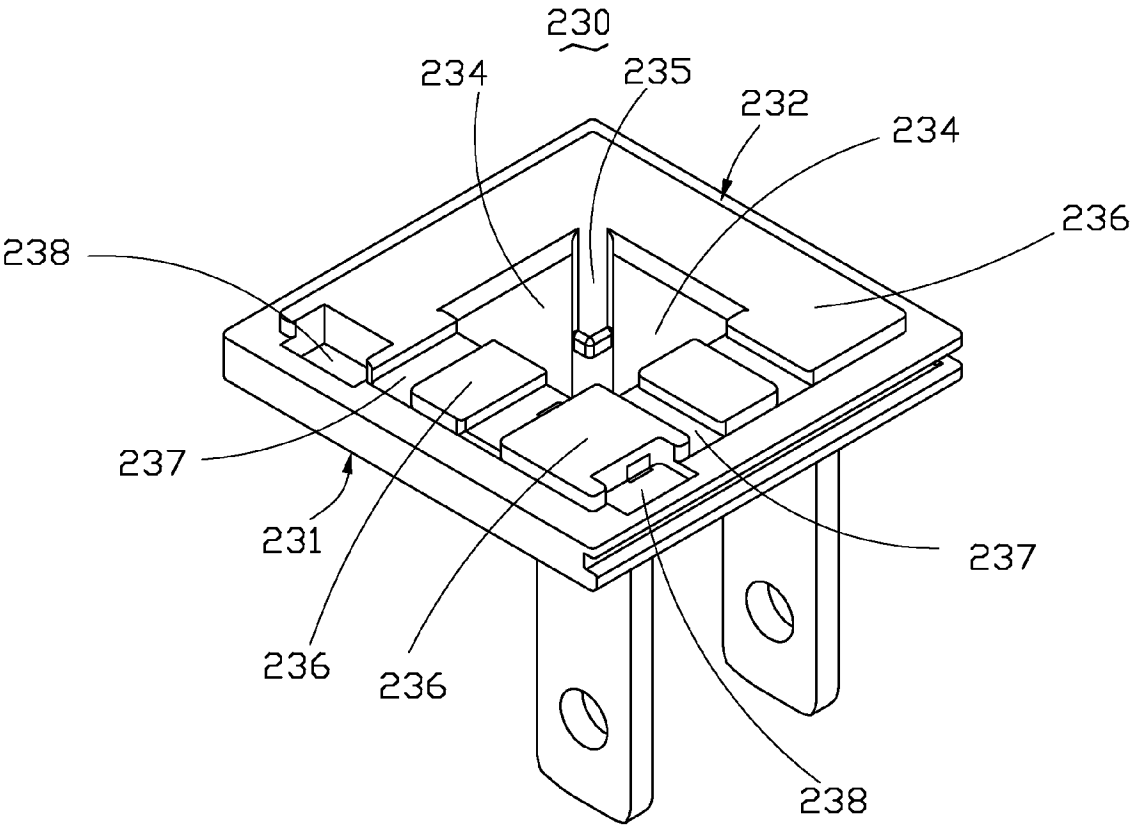
FIG. 9 is a perspective view of the second preferred embodiment of the connector plug in accordance with the present disclosure.
Figure 10:
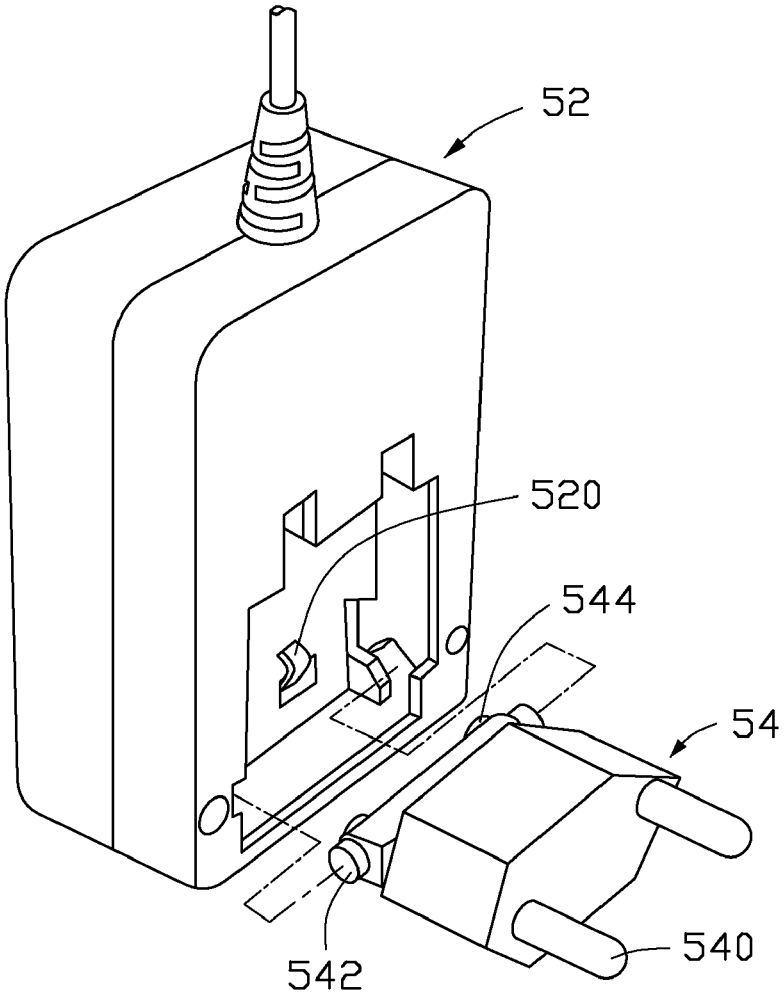
FIG. 10 (RELATED ART)
FIG. 10 is a perspective view of a conventional power device.

FIG. 8 is a disassembled perspective view of a power device 200 and FIG. 9 is a perspective view of the connector plug 230 in the second preferred embodiment. The power device 200 comprises a substrate portion 220 and the connector plug 230.

The substrate portion 220 has similar structure with the substrate portion 20 of the first preferred embodiment and one difference is that the substrate portion 220 comprises only a pair of contact terminals 224 protruding outwardly from a bottom of the recess portion 222.

The connector plug 230 has similar structure with the connector plug 30 of the first preferred embodiment. Similarly, the connector plug 230 also comprises a first side surface 231 and a second side surface 232 opposite to the first side surface 231. One difference is that the first side surface 231 defines only a pair of receiving slots 233 used for the pair of contact terminals 224 sliding along and a first groove 239 latched on a latching hook 223 of the substrate portion 220 by pressing an operating portion 235 when packaged. Another difference is that the second side surface 232 comprises a pair of sheet metals 234 and a first blocking wall 235 insulating the pair of sheet metals 234, which is configured substantially in a triangle shape respectively. The pair of sheet metals 234 and the first blocking wall 235 are disposed in the middle of the second side surface 232, and are surrounded by a plurality of second blocking walls 236 as well as a plurality of sliding grooves 237. Each of the plurality of sliding grooves 237 is configured between two adjacent second blocking walls 236.

The pair of contact terminals 224 slide along the corresponding sliding groove 237 and electrically connect with the pair of sheet metals 234, and the latching hook 223 engages with a second groove 238 on the second side surface 232 to mount the connector plug 230 onto the substrate portion 220. Similarly, in this embodiment, the connector plug 230 can be mounted on the substrate portion 220 on different directions, for example, the connector plug 230 can be turned for 90 degrees relative to the substrate portion 220 with the pair of sheet metals 234 turned for 90 degrees to conductively contact with the pair of contact terminals 224.

The substrate portion 220 and the connector plug 230 of the second preferred embodiment have similar structures and similar functions with the substrate portion 20 and the connector plug 30 of the first preferred embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A power device, comprising:

a substrate portion, defining a recess portion on a top wall of the substrate portion and a pair of receiving grooves extending from a bottom of the recess portion into the substrate portion, at least one contact terminal passing through the bottom of the recess portion and extending towards the recess portion; and a connector plug, comprising a main body and a pair of conducting strips protruding outwardly from a first side surface of the main body, the main body defining at least one receiving slot;

wherein the main body and the recess portion are both in a square shape allowing for mounting of the connector plug on the substrate portion, and allowing for the connector plug to be adjusted in the recess portion 90 degrees relative to the substrate portion;

in assembly, the main body of the connector plug is received in the recess portion, and the pair of conducting strips are received in the pair of receiving grooves correspondingly, and the contact terminals slide into the corresponding receiving slots to accommodate the connector plug in the substrate portion.

2. The power device as claimed in claim 1, wherein the substrate portion comprises a pair of first inside walls and a second inside wall to collectively form the recess portion to receive the connector plug, the pair of first inside walls is opposite to each other and is perpendicular to the second inside wall respectively.

3. The power device as claimed in claim 2, wherein the substrate portion comprises a pair of stopper portions protruding from a top portion of the corresponding first inside walls towards the recess portion to limit the connector plug moving on a perpendicular direction A relative to the substrate portion.

4. The power device as claimed in claim 3, wherein the substrate portion further comprises a pair of step portions opposite to the corresponding stopper portions and protruding from a bottom portion of the corresponding first inside walls towards the recess portion to engage with the connector plug.

5. The power device as claimed in claim 4, wherein the pair of stopper portions, the pair of first inside walls and the pair of step portions collectively form a pair of first sliding grooves configured in a "U" shape.

6. The power device as claimed in claim 2, wherein a position portion protrudes from the middle of the first inside wall towards the recess portion to position the connector plug relatively to the recess portion.

7. The power device as claimed in claim 6, wherein the main body of the connector plug is substantially in a rectangle shape and defines two successive second sliding grooves on two adjacent sides of the main body to receive the position portion.

8. The power device as claimed in claim 7, wherein a cross section of the second sliding groove is substantially "U" shaped.

9. The power device as claimed in claim 1, wherein the substrate portion further comprises a securing portion disposed on the top wall, the securing portion comprises an operating portion having a plurality of ribs in parallel with each other thereon and a latch hook protruding downwardly from the operating portion into the recess portion.

10. The power device as claimed in claim 9, wherein the operating portion is integrally formed with the top wall with elasticity operable to be pressed up and down and the latch hook is integrally formed with the operating portion.

11. The power device as claimed in claim 10, wherein the first side surface of the main body comprises a first blocking wall to engage with the latching hook to accommodate the connector plug into the substrate portion.

12. The power device as claimed in claim 10, wherein a plurality of second blocking walls protrude outwardly from a second side surface of the main body to engage with the latch hook to latch the connector plug with the substrate portion.

13. The power device as claimed in claim 12, wherein the second side surface comprises a first sheet metal and a second sheet metal insulating from the first sheet metal by the plurality of second blocking walls, the first sheet metal and the second sheet metal contact with the corresponding contact terminals to electrically connect the connector plug with the substrate portion.

14. The power device as claimed in claim 13, wherein the at least one contact terminal comprises a first contact terminal, a second contact terminal and a third contact terminal, the first contact terminal connects with the second contact terminal in a short circuit manner.

15. The power device as claimed in claim 14, wherein the first contact terminal conductively contacts with the first sheet metal and the third contact terminal conductively contacts with the second sheet metal, and this state is defined as a first state for the power device.

16. The power device as claimed in claim 14, wherein when the connector plug is turned for 90 degrees and mounted on the substrate portion, the first sheet metal conductively contacts with the second contact terminal and the second sheet metal conductively contacts with the third contact terminal, and this state is defined as a second state for the power device.

17. A power device, comprising:

a substrate portion, defining a recess portion on a top wall of the substrate portion and a pair of receiving grooves extending from a bottom of the recess portion into the substrate portion, at least one contact terminal passing through the bottom of the recess portion and extending towards the recess portion; and a connector plug, comprising a main body and a pair of conducting strips protruding outwardly from the main body, the main body defining at least one receiving slot;

wherein in assembly, the main body of the connector plug is received in the recess portion, and the pair of conducting strips are received in the pair of receiving grooves correspondingly to be hidden in the substrate portion, and the at least one contact terminal slides into the corresponding receiving slots to accommodate the connector plug in the substrate portion.

18. The power device as claimed in claim 17, wherein the substrate portion defines a pair of first sliding grooves at two opposite edges of the recess portion, and the main body of the connector plug is received in the recess portion via two opposite edges of the main body sliding into the pair of first sliding grooves respectively.

19. The power device as claimed in claim 18, wherein the substrate portion comprises a position portion configured in one of the pair of first sliding grooves, the main body defines two successive second sliding grooves on two adjacent sides of the main body, in assembly, the position portion is received in and engage with one of the two successive second sliding grooves.

20. The power device as claimed in claim 17, wherein the substrate portion further comprises a securing portion disposed on the top wall, and the securing portion comprises an operating portion and a latch hook protruding downwardly from the operating portion into the recess portion and used to engage with the main body to accommodate the connector plug into the substrate portion.

* * * * *